US011959202B2

(12) United States Patent
Kim et al.

(10) Patent No.: US 11,959,202 B2
(45) Date of Patent: Apr. 16, 2024

(54) APPARATUS FOR MANUFACTURING TEXTILE GRID WITH INCREASED ADHESION AND METHOD THEREOF

(71) Applicant: KOREA INSTITUTE OF CIVIL ENGINEERING AND BUILDING TECHNOLOGY, Gyeonggi-Do (KR)

(72) Inventors: Hyeong Yeol Kim, Gyeonggi-do (KR); Kyung Taek Koh, Gyeonggi-do (KR); Gum Sung Ryu, Gyeonggi-do (KR); Gi Hong An, Gyeonggi-do (KR); Dong Woo Seo, Gyeonggi-do (KR); Seung Seop Jin, Incheon (KR)

(73) Assignee: KOREA INSTITUTE OF CIVIL ENGINEERING AND BUILDING TECHNOLOGY, Gyeonggi-do (KR)

( * ) Notice: Subject to any disclaimer, the term of this patent is extended or adjusted under 35 U.S.C. 154(b) by 1162 days.

(21) Appl. No.: 16/698,884

(22) Filed: Nov. 27, 2019

(65) Prior Publication Data

US 2021/0062374 A1 Mar. 4, 2021

(30) Foreign Application Priority Data

Sep. 4, 2019 (KR) ..... 10-2019-0109419

(51) Int. Cl.
*D03D 13/00* (2006.01)
*D03D 1/00* (2006.01)
(Continued)

(52) U.S. Cl.
CPC ..... *D03D 13/004* (2013.01); *D03D 1/00* (2013.01); *D03D 15/497* (2021.01); *D04B 39/06* (2013.01);
(Continued)

(58) Field of Classification Search
None
See application file for complete search history.

(56) References Cited

U.S. PATENT DOCUMENTS 3,556,165 A * 1/1971 Jisa ..... D03D 13/004 66/190
3,855,678 A * 12/1974 Schroeder ..... B60C 9/0028 152/565
(Continued)

FOREIGN PATENT DOCUMENTS

KR 100341386 6/2002
KR 100886755 3/2009
(Continued)

*Primary Examiner* — Jethro M. Pence
(74) *Attorney, Agent, or Firm* — JCIPRNET

(57) ABSTRACT

Provided are an apparatus for manufacturing a textile grid with increased adhesion and a method thereof capable of integrating the textile grid with a concrete structure by increasing the adhesion of the textile grid when the concrete structure is built, repaired, or reinforced, increasing structural safety and durability of the concrete structure, increasing a working speed by coating a surface of the textile grid with an abrasive material powder that is a surface coating material in an automatic series of processes immediately after the textile grid is manufactured, and increasing coating performance by automatically inspecting and adjusting the amount of the coating material applied to the surface of the textile grid using a camera.

8 Claims, 10 Drawing Sheets

(51) Int. Cl.

| | |
|---|---|
| ***D03D 15/00*** | (2021.01) |
| ***D03D 15/40*** | (2021.01) |
| ***D04B 39/06*** | (2006.01) |
| ***D06B 1/02*** | (2006.01) |
| ***D06B 3/10*** | (2006.01) |
| ***D06B 3/36*** | (2006.01) |
| ***D06H 3/02*** | (2006.01) |
| ***D06H 3/08*** | (2006.01) |
| ***D06M 11/77*** | (2006.01) |
| ***D06M 11/83*** | (2006.01) |
| ***D06M 15/19*** | (2006.01) |

(52) U.S. Cl.
CPC ..... *D06B 1/02* (2013.01); *D06B 3/10* (2013.01); *D06B 3/36* (2013.01); *D06H 3/02* (2013.01); *D06H 3/08* (2013.01); *D06M 11/77* (2013.01); *D06M 11/83* (2013.01); *D06M 15/19* (2013.01)

(56) References Cited

U.S. PATENT DOCUMENTS 3,880,203 A * 4/1975 Frohlich ..... D03D 1/00 24/392
4,181,159 A * 1/1980 Frohlich ..... A44B 19/54 139/384 B
4,334,556 A * 6/1982 Frohlich ..... A44B 19/406 24/392
4,362,191 A * 12/1982 Frohlich ..... A44B 19/54 24/392
4,404,998 A * 9/1983 Frohlich ..... D03D 1/00 24/392
5,251,675 A * 10/1993 Frohlich ..... A44B 19/54 24/392
5,313,989 A * 5/1994 Frohlich ..... A44B 19/346 24/392
5,546,622 A * 8/1996 McAlister ..... D06B 1/02 8/151
5,769,130 A * 6/1998 Brielmann ..... D03D 1/0005 139/22
5,832,961 A * 11/1998 Shimono ..... D03D 1/00 139/442
5,935,706 A * 8/1999 Hoover ..... D06M 11/83 428/389
6,000,442 A * 12/1999 Busgen ..... D03D 13/004 428/36.1
6,045,680 A * 4/2000 Cawston ..... C23C 18/1644 205/159
6,330,892 B1 * 12/2001 Shimono ..... D03D 1/00 139/384 B
6,401,763 B2 * 6/2002 Shimono ..... D03D 1/00 24/392
6,418,975 B1 * 7/2002 Shimono ..... A44B 19/346 24/392
7,520,304 B2 * 4/2009 Shimono ..... A44B 19/54 139/384 B
8,151,418 B2 * 4/2012 Nakayama ..... A44B 19/12 24/396
8,814,953 B1 * 8/2014 Abbott ..... D06C 3/06 28/169
8,899,176 B2 * 12/2014 Sakaue ..... B05D 5/10 427/207.1
9,131,790 B2 * 9/2015 Agarwal ..... D03D 15/217
9,139,952 B2 * 9/2015 Hangley ..... A41B 5/00
9,481,950 B2 * 11/2016 Agarwal ..... D03D 15/00
9,493,892 B1 * 11/2016 Agarwal ..... D03D 47/3046
9,636,700 B2 * 5/2017 Nitschke ..... B05C 11/00
9,708,737 B2 * 7/2017 Agarwal ..... D03D 15/283
9,758,912 B2 * 9/2017 Abbott ..... D06B 19/0029
9,951,450 B2 * 4/2018 Joung ..... D06B 1/02
9,970,133 B2 * 5/2018 Ukuma ..... D03D 13/008
10,066,324 B2 * 9/2018 Agarwal ..... D03D 47/30
10,145,037 B2 * 12/2018 Davis ..... D03D 47/14
10,343,439 B2 * 7/2019 Matsumoto ..... B41J 2/325
10,400,364 B1 * 9/2019 Mayer ..... D03D 15/25
10,443,159 B2 * 10/2019 Agarwal ..... D03D 47/30
10,472,744 B2 * 11/2019 Agarwal ..... D03D 15/573
10,655,248 B2 * 5/2020 Youn ..... D03D 15/283
10,767,287 B2 * 9/2020 Gupta ..... D02G 1/0213
10,808,337 B2 * 10/2020 Agarwal ..... D02G 1/0213
10,927,464 B2 * 2/2021 Kim ..... C23F 13/18
11,150,147 B2 * 10/2021 Horter ..... G01L 1/146
11,168,414 B2 * 11/2021 Agarwal ..... A47G 9/0238
11,225,733 B2 * 1/2022 Agarwal ..... D02G 1/0266
11,279,151 B2 * 3/2022 Turner ..... B41F 16/02
11,359,311 B2 * 6/2022 Agarwal ..... D03D 15/225
11,466,456 B2 * 10/2022 Kim ..... D06M 15/705
11,629,446 B2 * 4/2023 Albert Revert ..... D06B 3/36 8/103
2004/0097148 A1 * 5/2004 Tucker, Jr. ..... D03D 13/004 442/205
2004/0097152 A1 * 5/2004 Boyd, Jr. ..... D04B 21/02 442/318
2004/0116020 A1 * 6/2004 Boyd, Jr. ..... D04B 21/02 442/203
2014/0150922 A1 * 6/2014 Lecostaouec ..... D03D 3/005 139/420 R
2015/0322597 A1 * 11/2015 Agarwal ..... D03D 15/217 139/420 R
2016/0244896 A1 * 8/2016 Shahkarami ..... B32B 5/00
2016/0289869 A1 * 10/2016 Shahkarami ..... D03D 15/43
2017/0101729 A1 * 4/2017 Rhee ..... D04H 1/4342
2018/0002839 A1 * 1/2018 Liao ..... D02J 1/08
2018/0370072 A1 12/2018 Pfaff
2019/0070802 A1 3/2019 Chomarat
2020/0190709 A1 * 6/2020 Gupta ..... D02G 1/18
2021/0017677 A1 * 1/2021 Gupta ..... D02J 1/02
2021/0032783 A1 * 2/2021 Gupta ..... D03D 15/49
2021/0039281 A1 * 2/2021 Fuse ..... D03D 15/267
2021/0054545 A1 * 2/2021 Okuno ..... A61F 2/06
2021/0071364 A1 * 3/2021 Martin ..... D21F 7/10
2021/0071365 A1 * 3/2021 Sealey, II ..... B32B 27/285
2021/0177568 A1 * 6/2021 Okuno ..... D03D 13/004
2021/0227992 A1 * 7/2021 Oomen ..... D03D 1/00
2021/0277547 A1 * 9/2021 Pearson ..... D03D 15/267
2021/0324549 A1 * 10/2021 Shahkarami ..... F41H 5/0485
2021/0324552 A1 * 10/2021 Egawa ..... D03D 13/004
2022/0042217 A1 * 2/2022 Maehara ..... D03D 47/25
2022/0316105 A1 * 10/2022 Agarwal ..... D03D 13/004

FOREIGN PATENT DOCUMENTS

KR 101109606 2/2012
KR 101186506 10/2012
KR 101248168 3/2013
KR 20190007515 1/2019

* cited by examiner

APPARATUS FOR MANUFACTURING TEXTILE GRID WITH INCREASED ADHESION AND METHOD THEREOF

CROSS-REFERENCE TO RELATED APPLICATION

This application claims priority to and the benefit of Korean Patent Application No. 10-2019-0109419, filed on Sep. 4, 2019, the disclosure of which is incorporated herein by reference in its entirety.

BACKGROUND

Field of the Invention

The present invention relates to a textile grid with increased adhesion, and more specifically, to an apparatus for manufacturing a textile grid which continuously coats a surface of a textile grid with abrasive material powders, which are surface coating materials that improve adhesive performance to concrete, and a method thereof.

Description of Related Art

Generally, a degradation phenomenon, in which quality of concrete is gradually degraded due to weather changes and actions of various polluted water, such as seawater, groundwater, and rainwater, and compounds, proceeds on various concrete structures constructed for construction and civil engineering. Therefore, safety inspections are regularly performed on these concrete structures, and when a safety inspection result does not meet a required strength of the concrete structure or damage, such as abnormal peeling, peeling and falling, or cracking, is found, repair and reinforcement operations for increasing a load carrying capacity and stiffness of the concrete structure should be performed.

As a technology related to the repair and reinforcement of such a concrete structure, a method of increasing a load carrying capacity of a concrete structure using a stainless-steel wire mesh assembled in a lattice form is disclosed. However, when the concrete structures are repaired and reinforced using a wire mesh, the quality may be affected by a tensile condition of the wire mesh attached to the concrete structure, and it is not easy to secure a tensile force of the wire mesh, and thus there is a disadvantage in which the repair and reinforcement effects are reduced.

Meanwhile, lattice-shaped geogrids (hereinafter, referred to as "grid") are a reinforcement material used for retaining-wall reinforcement, slope reinforcement, ground reinforcement, and the like when civil engineering construction is conducted. The grid requires high tensile strength and low tensile strain in addition to properties such as workability, frictional property, and the like.

A method of manufacturing such a grid generally includes injection-molding or extruding a plastic material, punching the injection-molded or extruded plastic material, and uniaxially or biaxially elongating the plastic material. However, the lattice-shaped grid using the injection-molded plastic has low tensile strength, is difficult to be manufactured in series of processes, and has limitations in size or shape.

Recently, high strength yarn is woven or knitted into a lattice-shaped textile so that a textile grid fabric is provided, a surface of the fabric is coated with a resin coating solution, such as polyvinyl chloride, bitumen, acryl, latex, a rubber-based resin, or the like, and high temperature heating treatment is performed on the surface, and thus a textile grid reinforcement is manufactured to be effectively used to newly construct and reinforce a concrete structure.

Further, since the textile grid reinforcement uses higher strength yarn than a plastic grid reinforcement, the textile grid reinforcement has high tensile strength and low tensile strain so as to have excellent structural material properties for constructing and reinforcing structures.

FIGS. 1*a*, 1*b* and 1*c* are view illustrating a general textile grid reinforcement and a structure reinforced by the textile grid reinforcement. FIG. 1*a* illustrates a textile grid reinforcement, FIG. 1*b* illustrates a sewage gutter reinforced by the textile grid reinforcement, and FIG. 1*c* illustrates a concrete wall reinforced by the textile grid reinforcement.

As shown in FIG. 1*a*, recently, a textile grid is produced by weaving or knitting high-strength yarn, such as carbon yarn, aramid yarn, or the like, into a lattice-shaped textile and impregnated with an epoxy, vinyl ester, a styrene butadiene rubber (SBR) resin, or the like, and a textile grid reinforcement 10 is manufactured. The textile grid reinforcement 10 has been effectively used for building, repairing, and reinforcing the concrete structures such as the sewage gutter shown in FIG. 1*b* or the concrete wall shown in FIG. 1*c*.

FIGS. 2*a* and 2*b* are views illustrating a textile grid reinforcement produced through a weaving method.

As shown in FIGS. 2*a* and 2*b*, a textile grid reinforcement 10 includes wefts 10*a* and warps 10*b*, wherein each of the wefts 10*a* and the warps 10*b* is impregnated with a bundle of yarn 11 and a resin 12, but the completed textile grid reinforcement 10 is soft enough to be wound in the form of a roll.

As shown in FIG. 2*b*, since the textile grid reinforcement produced through a weaving method is twisted-woven from the warps 10*b*, elongation in a warp direction of the warp 10*b* is larger than a weft direction of the weft 10*a* straightly disposed as a main direction.

Meanwhile, FIGS. 3*a* and 3*b* are views illustrating a weaving-knitting machine for manufacturing a textile grid.

There are various methods of manufacturing a textile grid, but as shown in FIGS. 3*a* and 3*b*, generally, for mass production, a lattice-shaped textile grid 23 may be manufactured through a method in which a plurality of wefts 21 and warps 22 cross to be coupled to each other.

The textile grid is disposed on a neutral axis of a thin layer structure, and since a stress is not theoretically applied to the neutral axis in a flexural structure, the textile grid needs to be separate upward or downward from the neutral axis.

When the textile grid according to the related art is manufactured, as shown in FIG. 2*a*, the yarn 11 is woven in a lattice shape, is impregnated with the resin 12, such as an epoxy, vinyl ester, or the like, and is cured so that the grid reinforcement 10 is manufactured. Further, when the concrete structures are built, repaired, or reinforced, the textile grid manufactured of a composite material is used as a reinforcement, but the grid of a composite material has only about one-third of concrete adhesive strength as compared to a reinforcement bar which is used as the most common reinforcement, and thus it is necessary to improve the adhesive strength to integrate the textile grid with structures.

Meanwhile, among methods for improving the adhesive strength according to the related art, the most effective method is a surface coating method in which silica sand or the like is attached to a surface of a textile grid to increase friction and mechanical interlocking.

As described above, in a process of coating a surface of a grid according to the related art, a resin is additionally impregnated into a surface of the textile grid cured after a grid is manufactured, and a coating material is applied. However, since the coating process is performed manually, there are the following problems.

Firstly, since a coating process is further performed manually after a textile grid is manufactured, the contents of the resin and the coating material to be applied during coating cannot be adjusted, and thus there is a problem of low coating precision.

Secondly, since a resin is secondly applied to the textile grid so that a content of resin, which is unnecessary for material properties, is increased, physical properties, such as tensile strength and adhesive strength of the textile grid, are affected, and thus there is a problem in which adhesion of a coating material is degraded.

Thirdly, the textile grid is manufactured in an automatic series of processes, but the coating is performed manually, and thus there is a problem in which a manufacturing time and cost increase.

Fourthly, since a coating method according to the related art has a limitation of a work space, there is a problem of limitation in manually coating a textile grid having a predetermined length or more.

Meanwhile, FIG. 4 is a view for describing a coating part of an apparatus for manufacturing a grid according to the related art.

A process of manufacturing a grid using a grid manufacturing device according to the related art sequentially includes a yarn supplying operation, a weaving operation, a coating operation, and a winding operation, and each of the operations is performed independently or serially, but in the manufacturing through a series of processes, a composition combination of devices for a series of processes is not complete.

In this case, the coating operation is an operation in which a surface of the woven textile grid is coated with a synthetic resin solution coating layer, as shown in FIG. 4, in the case of a coating part 30 according to the related art, a supplied textile grid 10 is impregnated in a water tank 31 filled with a coating solution, is guided upward from a guide roller 32 in the water tank 31, and passes through a gap between pressing rollers 33 vertically stacked so that a surface of the textile grid 10 is uniformly coated with the coating solution.

However, the surface of the textile grid 10 should be uniformly coated with the coating solution during the coating operation according to the related art, but there is a problem in which the coating solution is not uniformly applied to the surface of the textile grid 10 due to problems caused when the textile grid 10 enters between the pressing rollers 33 and by materials that form the pressing rollers 33.

Specifically, each of the pressing rollers 33 according to the related art includes a rubber layer formed around a rotating shaft thereof, and when the textile grid 10 passes through the gap between the pressing rollers 33 vertically stacked, a surface of the pressing roller 33 does not come into contact with an upper end of the weft 10*a* woven below the warp 10*b* of the textile grid 10 corresponding to a proceeding direction so that a coating solution is not uniformly applied and formed like water drop. That is, the heights of surfaces of the wefts 10*a* and the warps 10*b* are not constant due to a weaving state of the textile grid 10, but a problem occurs due to a structure of the pressing rollers 33 that do not consider structural properties of the textile grid 10.

Further, since a contact area of the textile grid 10 with a lower pressing roller 33 of the pressing rollers is large when the textile grid 10 enters the gap between the vertically stacked pressing rollers 33, a coating solution is excessively removed from a lower surface of the textile grid 10 rather than uniformly applied thereto, and thus a problem occurs in which an inappropriate coating state is formed. Further, an operation, in which the textile grid 10 is manufactured while a weaving speed and a coating speed of the textile grid 10 are maintained at constant tensile force and rate, should move to an operation in which the textile grid 10 is wound, but, according to the related art, there is a problem in which a winding operation immediately comes after a drying operation.

As the related art for solving the above-described problems, "Apparatus for Manufacturing Geogrid with Increased Coating Function" is disclosed in Korean Registered Patent No. 10-0886755 and described with reference to FIGS. 5*a* and 5*b*.

FIG. 5*a* is a configuration view illustrating an apparatus for manufacturing a grid with an improved coating function according the related art, and FIG. 5*b* is a view for describing a coating part of the apparatus for manufacturing a grid with an improved coating function.

Referring to FIG. 5*a*, the apparatus of manufacturing a textile grid according to the related art includes a supplying unit 41, a weaving unit 42, a coating unit 43, a drying unit 44, a rolling unit 45, and a winding unit 46.

The supplying unit 41 supplies synthetic yarn, which is a raw material of the textile grid 10, in a warp direction and a weft direction, wherein the synthetic yarn used for the textile grid 10 includes polyester yarn, aramid yarn, glass yarn, polyvinyl alcohol yarn, and the like, and generally, the polyester yarn that has excellent physical properties is mainly used.

The weaving unit 42 weaves the synthetic yarn supplied from the supplying unit 41 into a lattice-shaped fabric, and in this case, a rib that forms a lattice is formed of a plurality of wefts and warps, and the size and shape of the lattice, the thickness and quantity of the warps and wefts, and the like may be applied variously when a product is designed.

The coating unit 43 applies a coating solution to provide stability, durability and weather resistance to the textile grid 10 woven in a lattice form by the weaving unit 42, and in this case, the coating solution is applied on the fabric through an immersing method or a spraying method. Specifically, as known, various types of coating solutions, which use polyvinyl chloride, acrylic, latex, bituminous materials, and the like, as a main component, are used according to each purpose thereof, and generally, the textile grid for reinforcement may use a coating solution containing polyvinyl chloride resin as a main component.

As shown in FIG. 5*b*, in the apparatus for manufacturing a textile grid according to the related art, the coating unit 43 uniformly coats, after the woven textile grid 10 is immersed in the coating solution, the textile grid 10 with the coating solution using pressing rollers. The apparatus for manufacturing a textile grid includes a coating water tank 43*a*, a guide roller 43*b*, an insertion roller 43*c*, and a pair of pressing rollers 43*d*, wherein the coating water tank 43*a* accommodates the coating solution, the guide roller 43*b* rotates to convert a proceeding direction of the textile grid 10 toward an upper pressing roller of the pressing rollers 43*d* after the textile grid 10 that enters the coating water tank 43*a* is immersed in the coating solution, the insertion roller 43*c* is positioned in front of the pair of pressing rollers 43*d* and guides a direction so that the textile grid 10 laterally enters a gap between the pressing rollers 43*d*, and the pair of pressing rollers 43*d* remove an overabundant coating solution from the surface of the textile grid 10 and uniformly apply the coating solution to the surface thereof.

The pair of pressing rollers 43*d* are stacked vertically, and each of the pressing rollers 43*d* includes a rotating shaft formed in the center thereof and rotating, a rubber layer formed of a rubber material around the rotating shaft at a predetermined thickness, and a nonwoven layer formed of a nonwoven fabric around the rubber layer at a predetermined thickness.

The insertion roller 43*c* of the coating unit 43 guides a direction so that the textile grid 10 laterally enters a gap between the pair of pressing rollers 43*d*, and times of pressing an upper surface and a lower surface of the textile grid 10 and contact areas of the pressing rollers 43*d* are uniformly formed on the upper and lower surfaces of the textile grid so that coating is uniformly performed. That is, it is possible to solve a problem of inappropriate coating formed on the lower surface of the textile grid 10 in the conventional structure excluding the insertion roller 43*c* in which a contact area of a lower pressing roller of the pressing rollers and the textile grid 10 is large and thus the coating solution is removed excessively.

Further, the pressing rollers 43*d* further including a nonwoven layer may uniformly press the wefts and the warps of the textile grid 10, of which heights are not constant, according to elasticity of the nonwoven layer, uniformly remove a coating solution excessively applied on the warps and the wefts of the textile grid 10, and uniformly spread and apply the coating solution.

Referring to FIG. 5*a* again, the drying unit 44 dries and thermally treats the coating solution applied to the textile grid 10 by the coating unit 43, and a coating solution on the surface is dried and thermally heated while the textile grid 10 passes through the drying unit 44 with a heater.

The rolling unit 45, which is a device for preventing contraction of the textile grid 10 dried and thermally treated by the drying unit 44 and allows a plurality of rollers to pass in a zigzag form for uniformity of winding tension, prevents contraction and maintains tension while allowing the plurality of rollers formed on an upper portion and a lower portion thereof to be spaced apart from each other while the textile grid 10 rotates in a zigzag form.

The winding unit 46 winds the textile grid 10 that passes through the rolling unit 45 and may generate a rotating force by a speed reducing motor mounted on one end of a roll-rotating shaft 47 of the winding unit 46, and the textile grid 10 formed through rotation of the roll-rotating shaft 47 is wound in the form of a roll.

When the textile grid according to the related art is manufactured, a series of treatment processes is consecutively performed so that productivity of the textile grid can be increased. Further, the apparatus for manufacturing a textile grid with an increased coating function can reduce a failure rate of the textile grid, increase reliability of the coating process, and firmly applies the coating solution to the surface of the textile grid so as to increase stability, durability, and weather resistance of the textile grid.

However, according to the apparatus for manufacturing a grid with an increased coating function according to the related art, a textile grid for reinforcement uses a coating solution mainly including a polyvinyl chloride resin as a main component, and the coating unit 43 for coating a coating solution includes a coating water tank 43*a*, a guide roller 43*b*, an insertion roller 43*c*, and a pair of pressing rollers 43*d*, and the textile grid is immersed in the coating solution, and thus coating is excessively performed.

RELATED ART DOCUMENTS

Patent Documents (Patent Document 0001) Korean Registered Patent No. 10-0886755 (Filed on Oct. 22, 2008), Title of invention: "Apparatus for Manufacturing Geogrid with Increased Coating Function"

(Patent Document 0002) Korean Registered Patent No. 10-1248168 (Filed on May 23, 2011), Title of invention: "Method of Manufacturing High Strength Heat Resistant Fiber Grid"

(Patent Document 0003) Korean Registered Patent No. 10-0341386 (Filed on Aug. 6, 1999), Title of invention: "Method of Manufacturing Textile Geogrid"

(Patent Document 0004) Korean Laid-Open Patent Publication No. 2019-0007515 (Published on Jan. 22, 2019), Title of invention: "Method of Manufacturing Geogrid Coated with Recycled PVC Resin"

(Patent Document 0005) Korean Registered Patent No. 10-1109606 (Filed on Mar. 15, 2011), Title of invention: "Textile Geogrid and Manufacturing Method Thereof"

(Patent Document 0006) Korean Registered Patent No. 10-1186506 (Filed on Jan. 9, 2012), Title of invention: "Method of Manufacturing Lattice-Shaped Textile Geogrid and Textile Geogrid Formed Therethrough"

SUMMARY

According to an aspect of the present invention, there is provided an apparatus for manufacturing a textile grid with increased adhesion, which is a manufacturing apparatus for manufacturing a textile grid for building, repairing, or reinforcing a concrete structure, the apparatus including a fabric yarn supplying unit that supplies textile grid fabric yarn in the form of a bundle of yarn, a weaving-knitting machine that forms a woven-knitted textile grid with a lattice form in a manner in which the fabric yarn is woven and knitted so that wefts and warps cross to be coupled to each other, a resin impregnation tank that impregnates the woven-knitted textile grid with a resin to form a resin impregnated textile grid, a coating chamber that includes a first coating material spraying nozzle and a second coating material spraying nozzle installed therein, before the resin impregnated textile grid is cured, allows a surface of the resin impregnated textile grid to be coated with abrasive material powder that is a surface coating material, and forms a coated textile grid, a camera that is installed at a rear end of the coating chamber and captures a coating-image to inspect a coating state of the coated textile grid, and a controlling device that adjusts a spraying amount of the surface coating material according to the coating-image captured by the camera, wherein the adhesion of the textile grid to a concrete structure is increased by the abrasive material powder that is the surface coating material.

The coating chamber may be formed as a closed space, and coating may be performed using at least two coating material spraying nozzles to spray a coating material to both surfaces of the resin impregnated textile grid.

The spraying amount of the coating material sprayed on the surface of the resin impregnated textile grid may be determined by a sprayed coating material directly sprayed from the first and second coating material spraying nozzles and a scattered coating material scattered in the coating chamber.

The abrasive material powder that is the surface coating material may be sand, silica sand, or alumina oxide powder.

The apparatus for manufacturing a textile grid with increased adhesion may further include a surface coating material supplying unit that supplies a coating material to the first and second coating material spraying nozzles in the coating chamber and adjusts the spraying amount of the coating material under control of the controlling device.

The apparatus for manufacturing a textile grid with increased adhesion may further include a resin curing chamber that allows the coated textile grid formed in the coating chamber to be cured to form a cured textile grid and a winding unit that winds the cured textile grid of the resin curing chamber.

The controlling device may include a coating-image collecting part that collects a coating image, which is an image of a coated coating material, captured by the camera, a data processing part that processes data to analyze the coating image collected by the coating-image collecting part, a coating state determining part that determines whether a coating state of the surface of the coated textile grid is appropriate based on the data processed by the data processing part, and a coating material spray adjusting part that adjusts the spraying amount of the coating material supplied to the first and second coating material spraying nozzles in the coating chamber when a state of the coating material applied on the surface of the coated textile grid is not appropriate as a result determined by the coating state determining part.

The controlling device may further include a pull-out motor speed adjusting part that adjusts a speed of a pull-out motor installed in front of the winding unit to adjust a coating amount of the coating material applied to the surface of the resin impregnated textile grid.

According to another aspect of the present invention, there is provided a method of manufacturing a textile grid with increased adhesion, which is a manufacturing method for manufacturing a textile grid for building, repairing, or reinforcing a concrete structure, the method including (a) supplying fabric yarn for a textile grid in the form of a bundle of yarn using a fabric yarn supplying unit, (b) weaving and knitting the bundle of yarn into a woven and knitted textile grid using a weaving-knitting machine, (c) impregnating the woven and knitted textile grid with a resin in a resin impregnation tank and forming a resin impregnated textile grid by removing an overabundant resin, (d) under control of a controlling device, applying an abrasive material powder, which includes a surface coating material, to a surface of the resin impregnated textile grid using a first coating material spraying nozzle and a second coating material spraying nozzle and forming a coated textile grid, and (e) capturing an image of the coated textile grid, which is coated with the surface coating material, using a camera and inspecting a coating state, wherein, when the controlling device determines that a state of the coating material applied on a surface of the coated textile grid is not appropriate, the controlling device adjusts a spraying amount of the coating material supplied to the first and second coating material spraying nozzles in the coating chamber so that the adhesion of the textile grid to the concrete structure is increased by the abrasive material powder that includes the surface coating material.

When the controlling device determines that the state of the coating material applied on the surface of the coated textile grid is not appropriate, the controlling device may adjust a speed of a pull-out motor installed in front of a winding unit to adjust the coating amount of a coating material applied to the surface of the resin impregnated textile grid.

The method of manufacturing a textile grid with increased adhesion may further include (f) curing the coated textile grid coated with the surface coating material in a resin curing chamber to form a cured textile grid and (g) winding the cured textile grid around a winding unit.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1A:
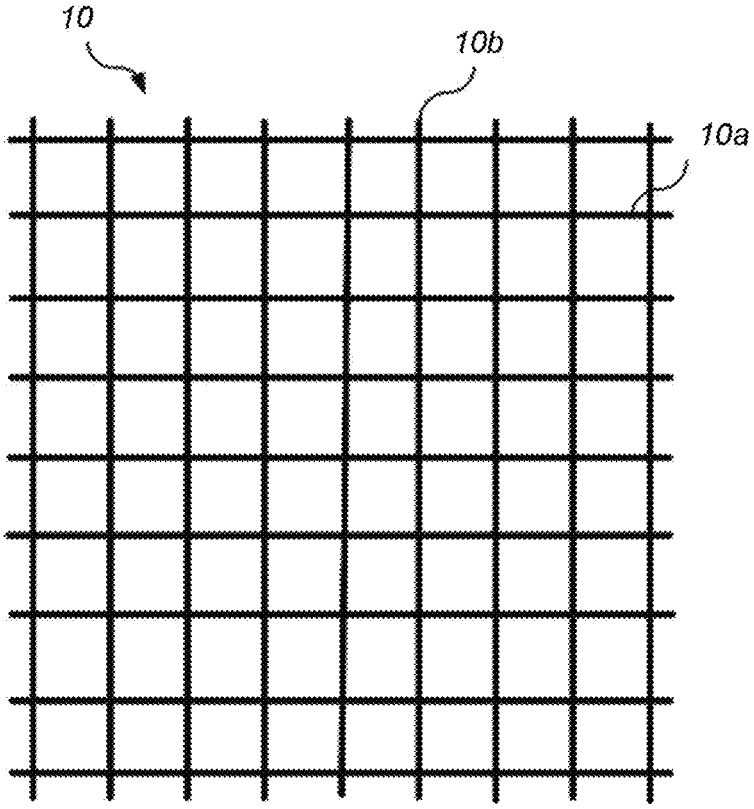
FIGS. 1*a*, 1*b* and 1*c* illustrate a general textile grid reinforcement and examples of structures reinforced thereby.
Figure 1B:
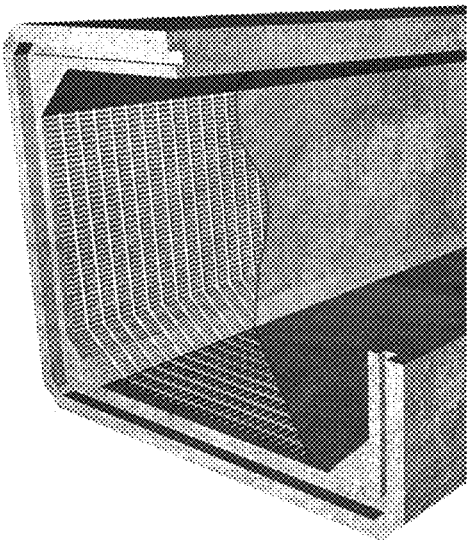
Figure 1C:
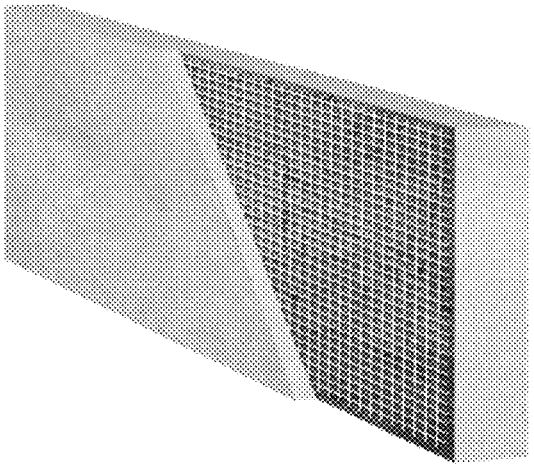
Figure 2A:
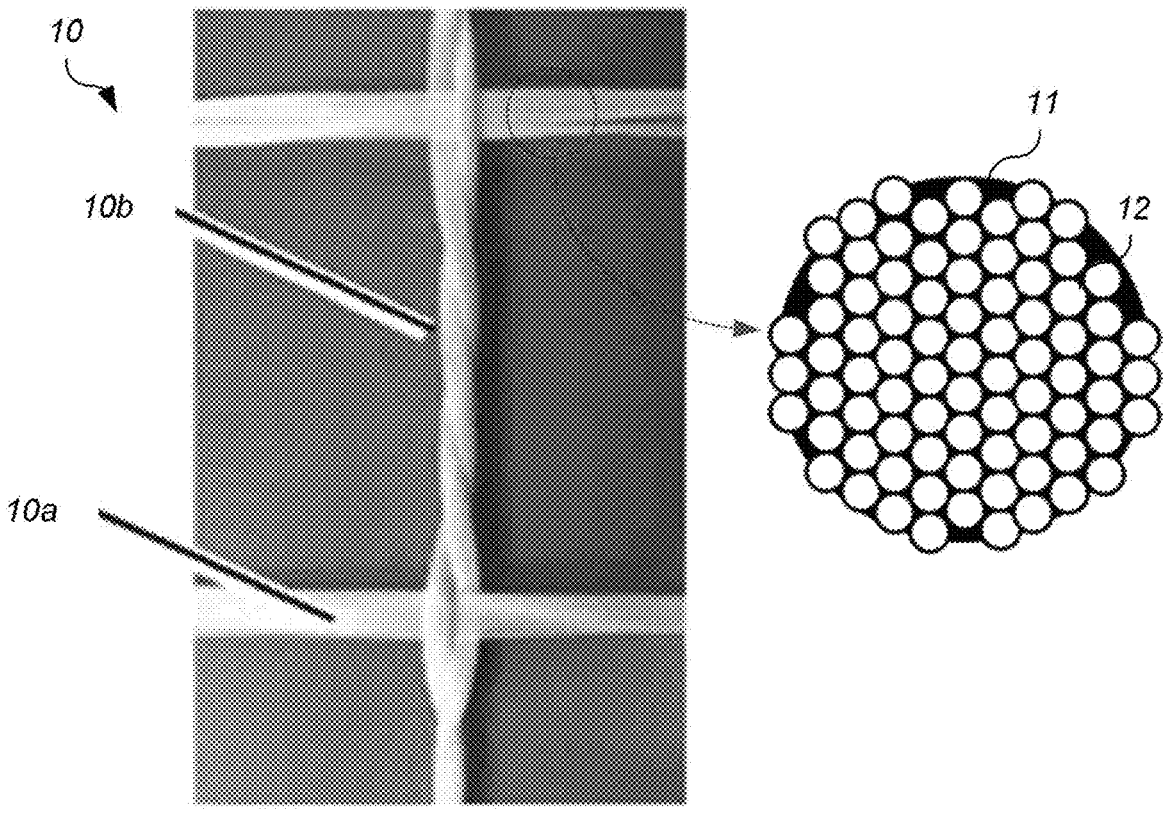
FIGS. 2*a* and 2*b* illustrate a textile grid reinforcement manufactured through a weaving method.
Figure 2B:
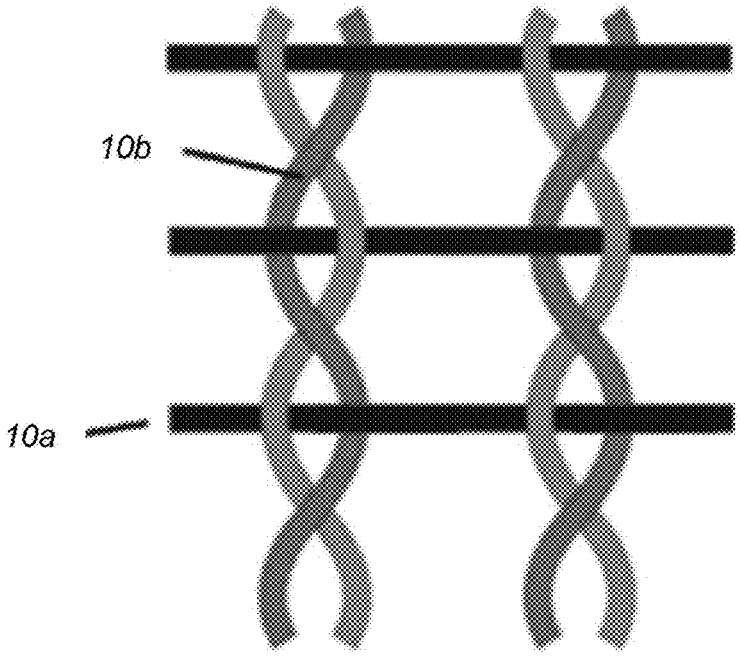
Figure 3A:
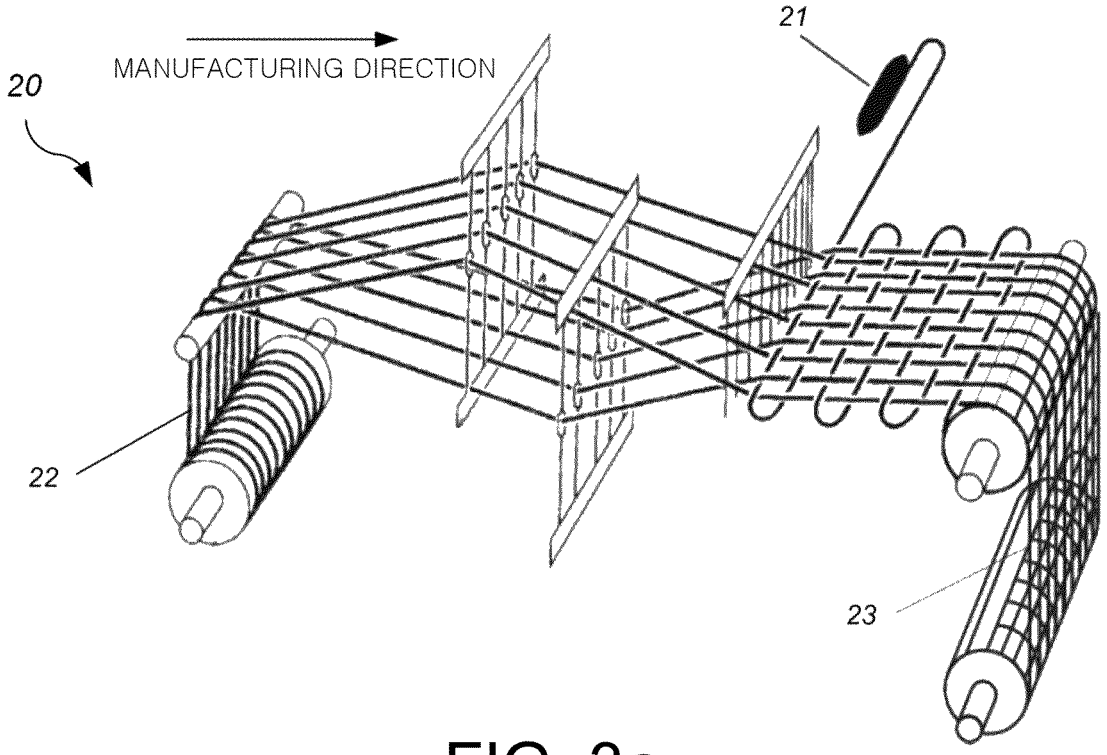
FIGS. 3*a* and 3*b* are views illustrating a weaving-knitting machine for manufacturing a textile grid.
Figure 3B:
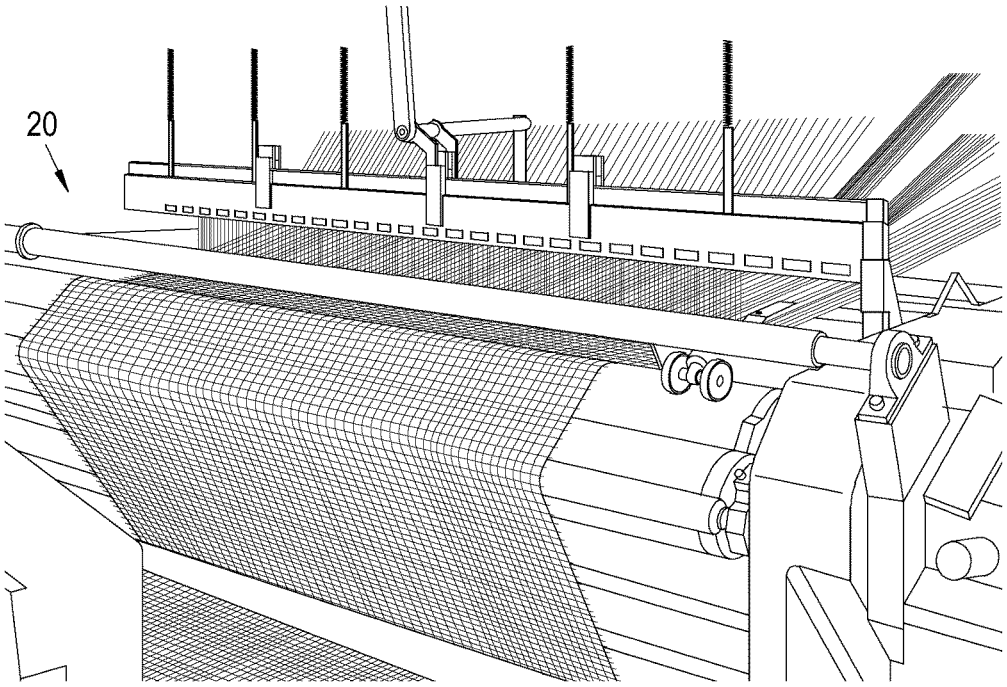
Figure 4:
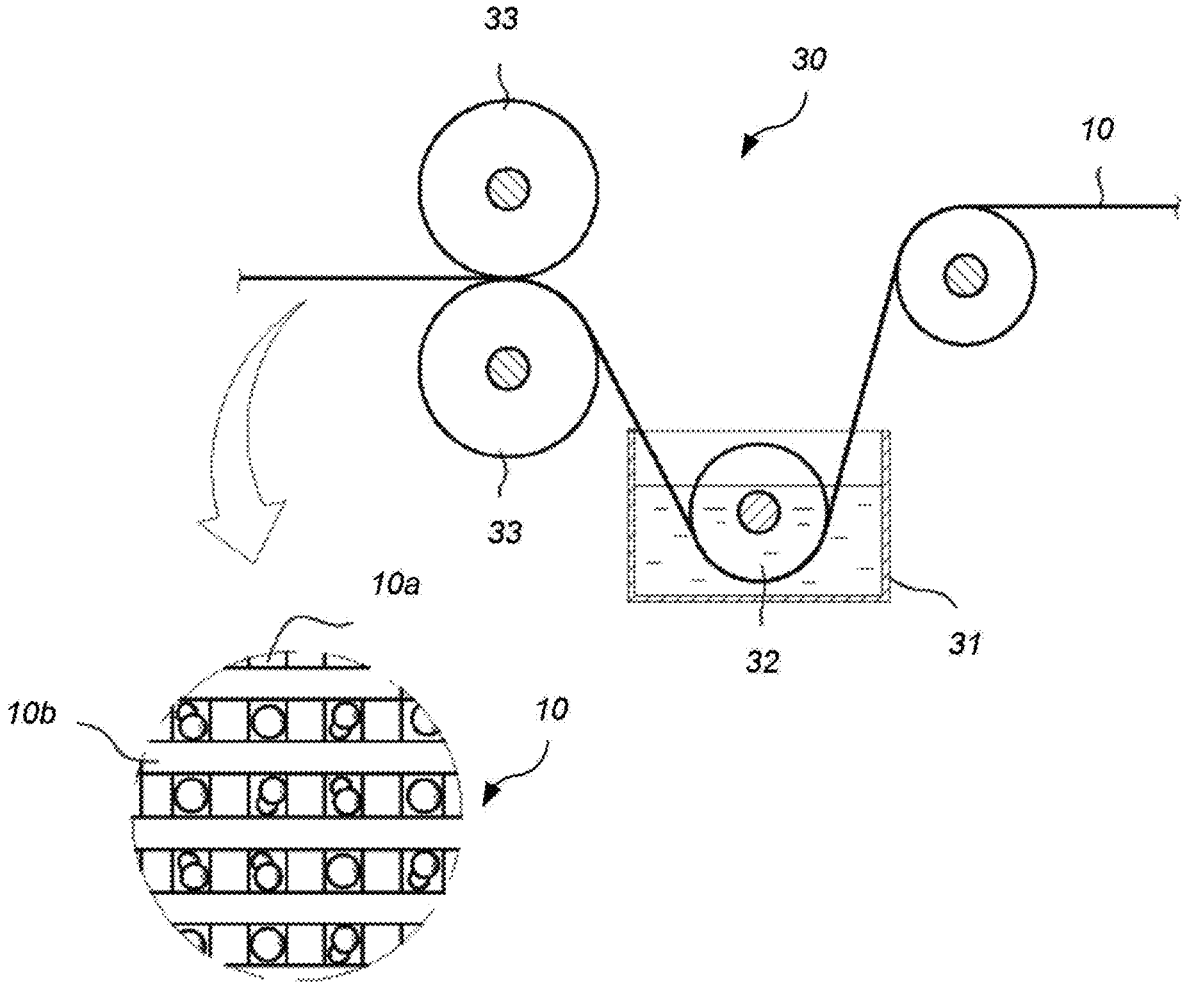
FIG. 4 is a view for describing a coating part of an apparatus for manufacturing a grid according to a related art.
Figure 5A:
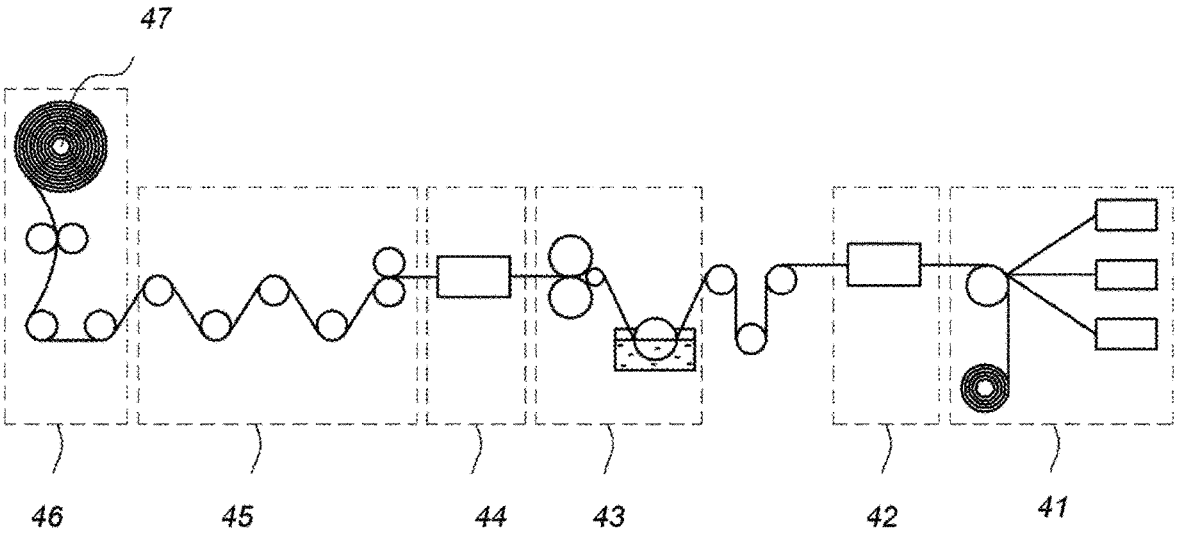
FIG. 5*a* is a configuration view illustrating an apparatus for manufacturing a grid with an improved coating function according to a related art.
Figure 5B:
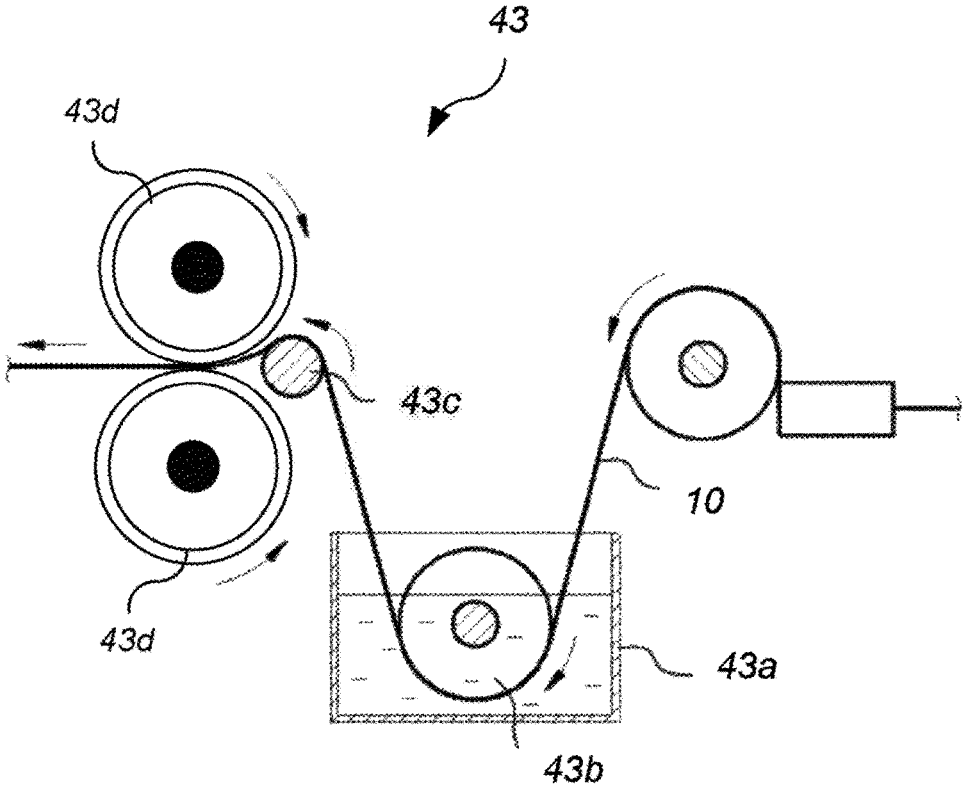
FIG. 5*b* is a view illustrating a coating part of the apparatus of manufacturing a grid with an improved coating function.

Hereinafter, embodiments that are easily performed by those skilled in the art will be described in detail with reference to the accompanying drawings. However, the embodiments of the present invention may be implemented in several different forms and are not limited to embodiments described herein. In addition, parts irrelevant to description will be omitted in the drawings to clearly explain the embodiments of the present invention. Similar parts are denoted by similar reference numerals throughout this specification.

Throughout the specification, when a portion "includes" an element, the portion may include the element or another element may be further included therein unless otherwise described.

[Apparatus 100 for Manufacturing a Textile Grid with Increased Adhesion]

Figure 6:
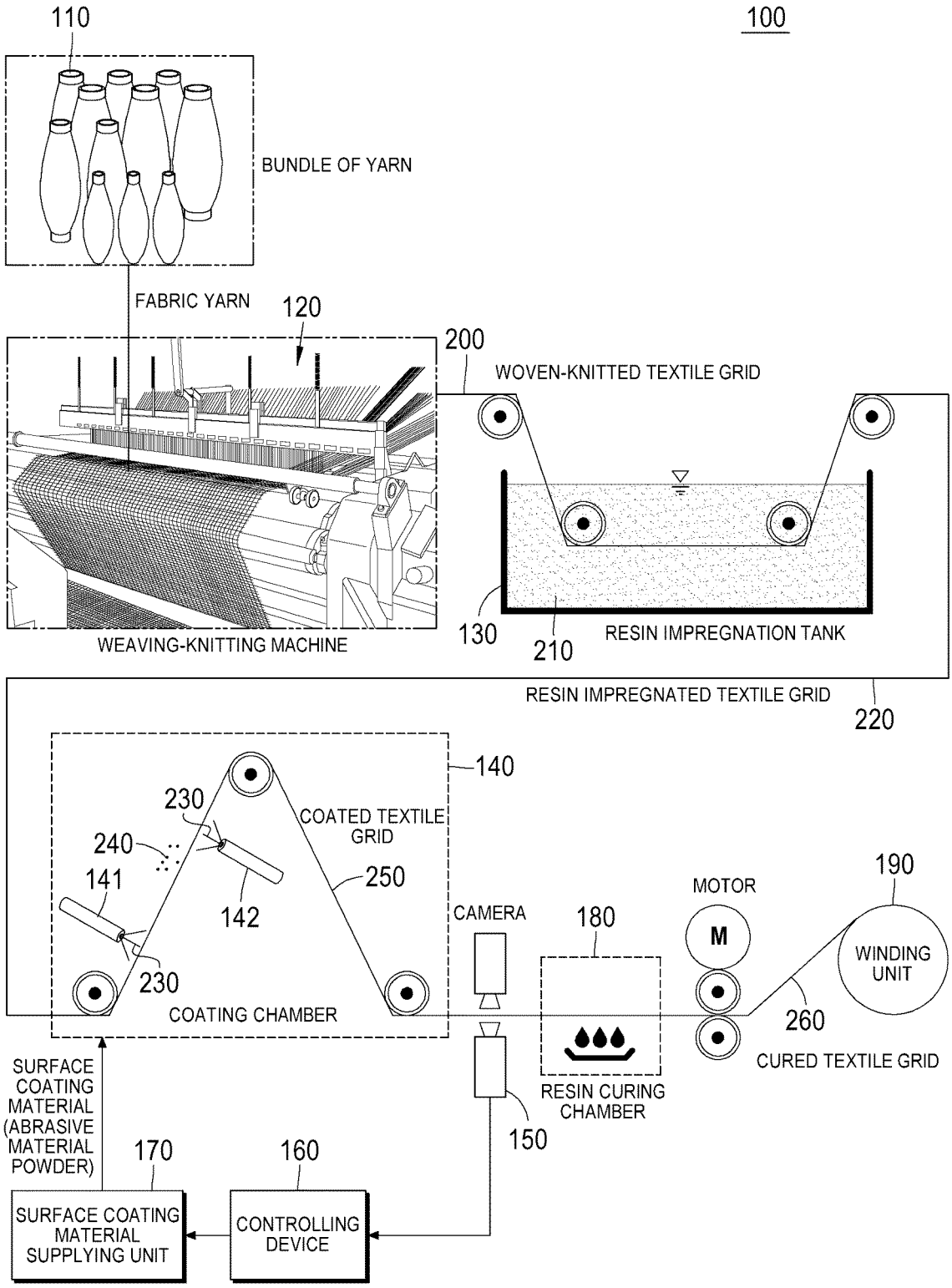
FIG. 6 is a configuration view of an apparatus for manufacturing a textile grid with increased adhesion according to an embodiment of the present invention.
Figure 7:
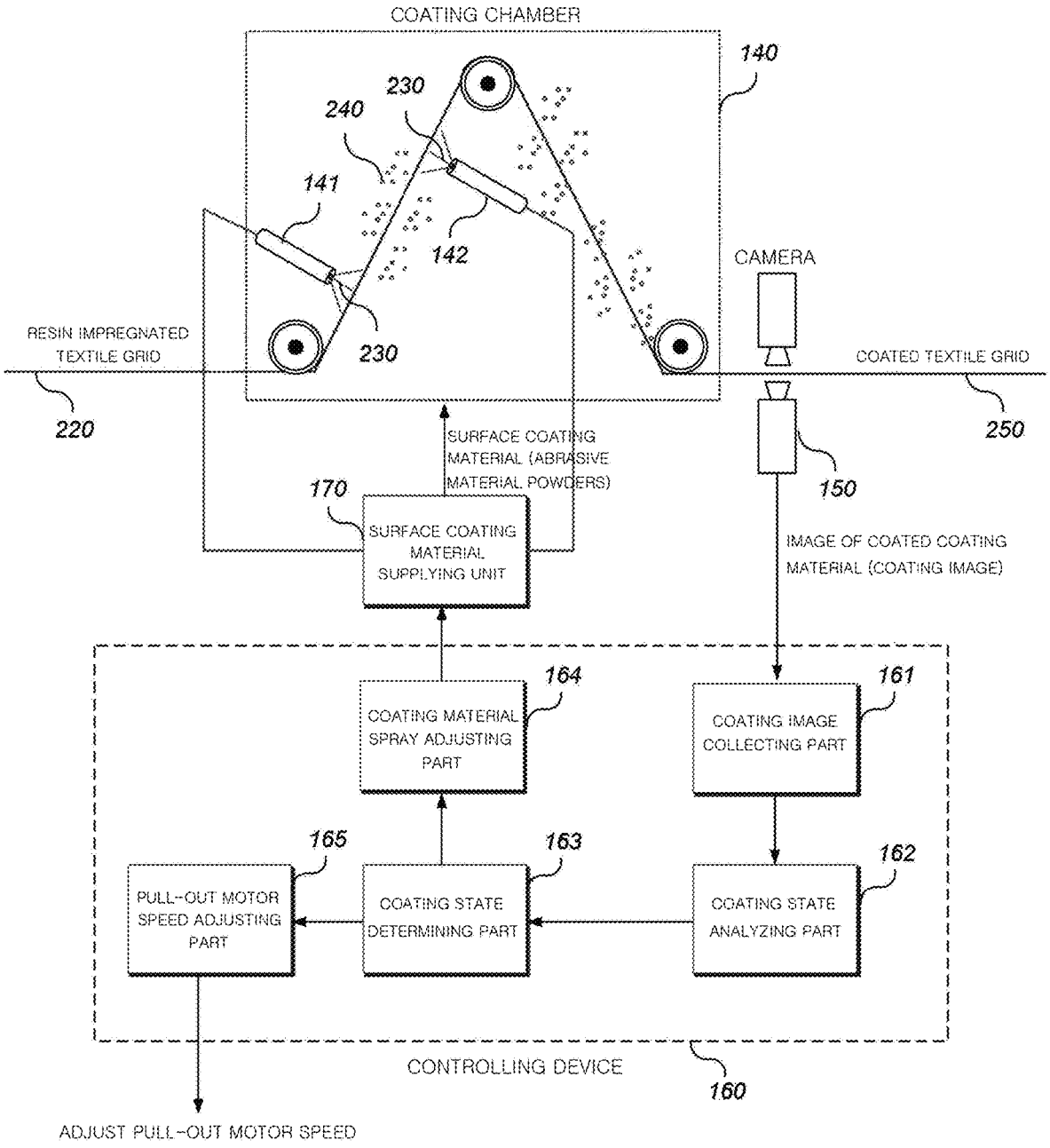
FIG. 7 is a specific configuration view illustrating a controlling device in the apparatus for manufacturing a textile grid with increased adhesion according to the embodiment of the present invention.

FIG. 6 is a configuration view of an apparatus for manufacturing a textile grid with increased adhesion according to an embodiment of the present invention, and FIG. 7 is a specific configuration view illustrating a controlling device in the apparatus for manufacturing a textile grid with increased adhesion according to the embodiment of the present invention.

Referring to FIG. 6, the apparatus 100 for manufacturing a textile grid with increased adhesion according to the embodiment of the present invention, which is a manufacturing apparatus for manufacturing a textile grid for building, repairing, or reinforcing a concrete structure, includes a fabric yarn supplying unit 110, a weaving-knitting machine 120, an resin impregnation tank 130, a coating chamber 140, a camera 150, a controlling device 160, a surface coating material supplying unit 170, a resin curing chamber 180, and a winding unit 190.

The fabric yarn supplying unit 110 supplies textile grid fabric yarn in the form of a bundle of yarn.

The weaving-knitting machine 120 forms a woven-knitted textile grid 200 in a lattice shape through a method in which the fabric yarn is woven and knitted so that wefts and warps cross to be coupled to each other.

The resin impregnation tank 130 allows the woven-knitted textile grid 200 to be impregnated with a resin 210 to form a resin impregnated textile grid 220. In this case, as described below, coating is performed on the resin impregnated textile grid 220 that passes through the resin impregnation tank 130 is impregnated with the resin 210 while the uncured resin impregnated textile grid 220 enters and passes through the coating chamber 140, and the resin impregnated textile grid 220 is cured after the coating.

The coating chamber 140 includes a first coating material spraying nozzle 141 and a second coating material spraying nozzle 142 installed therein, and the resin impregnated textile grid 220 is coated with abrasive material powder, which is a surface coating material, before being cured to form a coated textile grid 250. Specifically, the coating chamber 140 is formed as a closed space, and coating is performed by spraying the coating material on both surfaces of the resin impregnated textile grid 220 using the at least two first and second coating material spraying nozzles 141 and 142, wherein the spraying amount of the coating material sprayed on the surface of the resin impregnated textile grid 220 is determined by a sprayed coating material 230 directly sprayed and a coating material 240 scattered in the coating chamber 140. In this case, the surface coating material including the sprayed coating material 230 and the scattered coating material 240 may be formed of abrasive material powders such as sand, silica sand, alumina oxide powder, or the like.

Particularly, the apparatus 100 for manufacturing a textile grid with increased adhesion according to the embodiment of the present invention is for continuously coating a surface of the textile grid with abrasive material powder, which is a surface coating material, to increase adhesive performance of the textile grid to concrete. In this case, the surface of the resin impregnated textile grid 220 is coated with the abrasive material powders in the coating chamber 140.

Further, the surface coating material is sprayed on both surfaces of the resin impregnated textile grid 220 by the at least two coating material spraying nozzles 141 and 142 in the coating chamber 140. In this case, the spraying amount of the coating material may be determined by the sprayed coating material 230 directly sprayed and the scattered coating material 240 scattered in the coating chamber 140.

The camera 150 is installed on a rear end of the coating chamber 140 and captures a coating image to inspect a coating state of the coated textile grid 250. That is, the coated textile grid 250 coated with the abrasive material powder that is surface coating material is captured by imaging equipment such as the camera 150. Thus, the amount of the coating material applied to the coated textile grid 250 can be precisely measured by the imaging equipment such as the camera 150, and therefore, the surface coating material can be uniformly applied to the surface of the resin impregnated textile grid 220.

As shown in FIG. 7, the controlling device 160 adjusts the spraying amount of the surface coating material according to a coating-image captured by the camera 150.

The surface coating material supplying unit 170 supplies the coating material to the first and second coating material spraying nozzles 141 and 142 in the coating chamber 140 and adjusts the spraying amount of the coating material under control of the controlling device 160.

The resin curing chamber 180 cures the coated textile grid 250 formed in the coating chamber 140 to form a cured textile grid 260.

The winding unit 190 winds the cured textile grid 260 of the resin curing chamber 180. In this case, the apparatus 100 for manufacturing a textile grid with increased adhesion according to the embodiment of the present invention adjusts the spraying amount of the coating material of the first and second coating material spraying nozzles 141 and 142 in the coating chamber 140 or adjusts a speed of a pull-out motor installed at a front end of the winding unit 190 to adjust a winding speed of the coated textile grid 250 so as to precisely adjust the amount of coating.

Specifically, referring to FIG. 7, the controlling device 160 includes a coating-image collecting part 161, a data processing part 162, a coating state determining part 163, a coating material spray adjusting part 164, and a pull-out motor speed adjusting part 165.

The coating-image collecting part 161 of the controlling device 160 collects a coating-image in which a coating material is applied and is captured by the camera 150, and the data processing part 162 of the controlling device 160 processes data to analyze the coating-image collected by the coating-image collecting part 161.

The coating state determining part 163 of the controlling device 160 determines whether the coating state of the surface of the coated textile grid 250 is appropriate according to the data processed by the data processing part 162, and, as a result of the determination of the coating state determining part 163, when the state of the coating material applied on the coated textile grid 250 is not appropriate, the coating material spray adjusting part 164 of the controlling device 160 adjusts the spraying amount of the coating material supplied to the first and second coating material spraying nozzles 141 and 142 in the coating chamber 140.

The pull-out motor speed adjusting part 165 of the controlling device 160 adjusts a speed of the pull-out motor M installed in front of the winding unit 190 to adjust the coating amount of the coating material applied to the surface of the resin impregnated textile grid 220.

Therefore, the apparatus 100 for manufacturing a textile grid with increased adhesion according to the embodiment of the present invention precisely measures and inspects the coating amount of the surface coating material applied to the coated textile grid 250 using the imaging equipment, such as the camera 150, immediately after the resin impregnated textile grid 220 coated with the surface coating material passes through the coating chamber 140. After the coating amount of the surface coating material is measured with the image, the spraying amount of the coating material is adjusted, and thus an initially targeted application of the coating material can be precisely performed. Meanwhile, another method of adjusting the coating amount of the coating material to be applied is to adjust a speed of the pull-out motor installed in front of the winding unit 190. Next, after the coating amount of the surface coating material is measured, the coated textile grid 250 is cured while passing through the resin curing chamber 180, and the cured textile grid 260 is wound by the winding unit 190. Therefore, the adhesion of the textile grid to the concrete structure can be increased by the abrasive material powder that is the surface coating material.

Figures 8A, 8B:
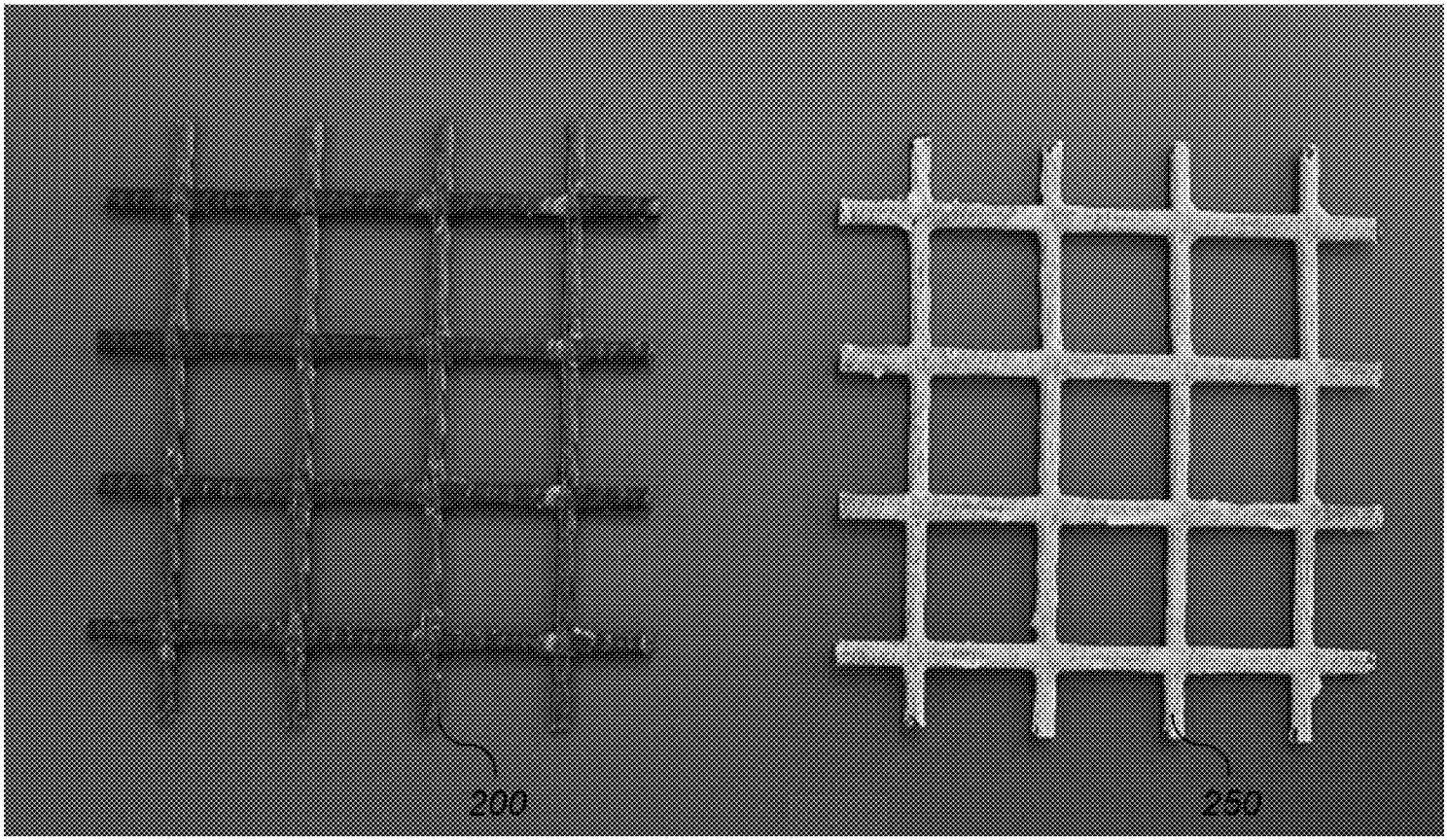
FIGS. 8*a* and 8*b* are views illustrating a textile grid with increased adhesion by the apparatus for manufacturing a textile grid with increased adhesion according to the embodiment of the present invention.
Figure 9:
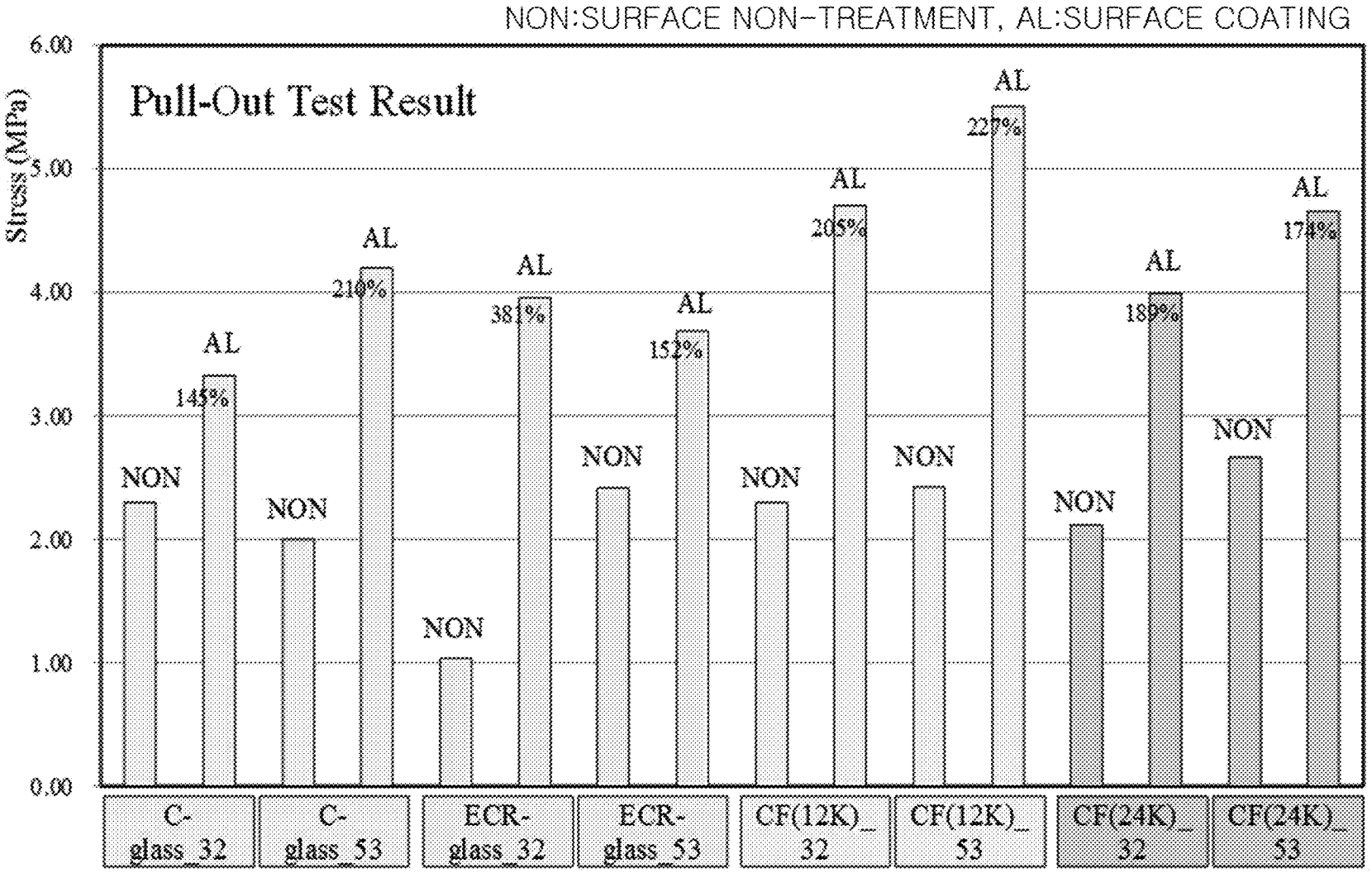
FIG. 9 is a view illustrating an inspection result that represents adhesive strengths before and after the textile grid with increased adhesion according to the embodiment of the present invention is coated.

Meanwhile, FIGS. 8*a* and 8*b* are views illustrating a textile grid with increased adhesion by the apparatus for manufacturing a textile grid with increased adhesion according to the embodiment of the present invention, and FIG. 9 is a view illustrating an inspection result that represents adhesive strengths before and after the textile grid with increased adhesion according to the embodiment of the present invention is coated.

Typically, a noncorrosive high strength textile grid reinforcement, which is a textile grid reinforcement, is used as a concrete reinforcement bar replacement, and in this case, to manufacture the textile grid, high strength yarn, such as carbon yarn, aramid yarn, or the like may be woven or knitted into a lattice-shaped textile, and an epoxy, vinyl ester, styrene-butadiene rubber (SBR) resin, or the like may penetrate into the textile grid. However, as shown in FIG. 8*a*, since the textile grid has a lower adhesion to concrete than a reinforcement bar, as shown in FIG. 8*b*, the textile grid is coated with the surface coating material. That is, FIG. 8*a* illustrates the resin impregnated textile grid 220 before the textile grid is coated with the surface coating material, and FIG. 8*b* illustrates the coated textile grid 250 after the resin impregnated textile grid is coated with the surface coating material.

Further, as shown in FIG. 9, as an inspect result that presents adhesive strengths before and after the textile grid is coated by the apparatus for manufacturing a textile grid with increased adhesion according to the embodiment of the present invention, it is shown that, for example, when a surface of the textile grid is coated with alumina oxide powders, the adhesive strength can be maximally increased up to 220%.

Finally, in the case of the apparatus 100 for manufacturing a textile grid with increased adhesion according to the embodiment of the present invention, the surface of the textile grid is coated with abrasive material powder, which is surface coating material, in an automatic series of processes immediately after the textile grid is manufactured so that a working speed can be increased, and the amount of the coating material applied to the surface of the textile grid is automatically inspected using a camera and adjusted so that coating performance can be increased.

[Method of Manufacturing Textile Grid with Increased Adhesion]

Figure 10:
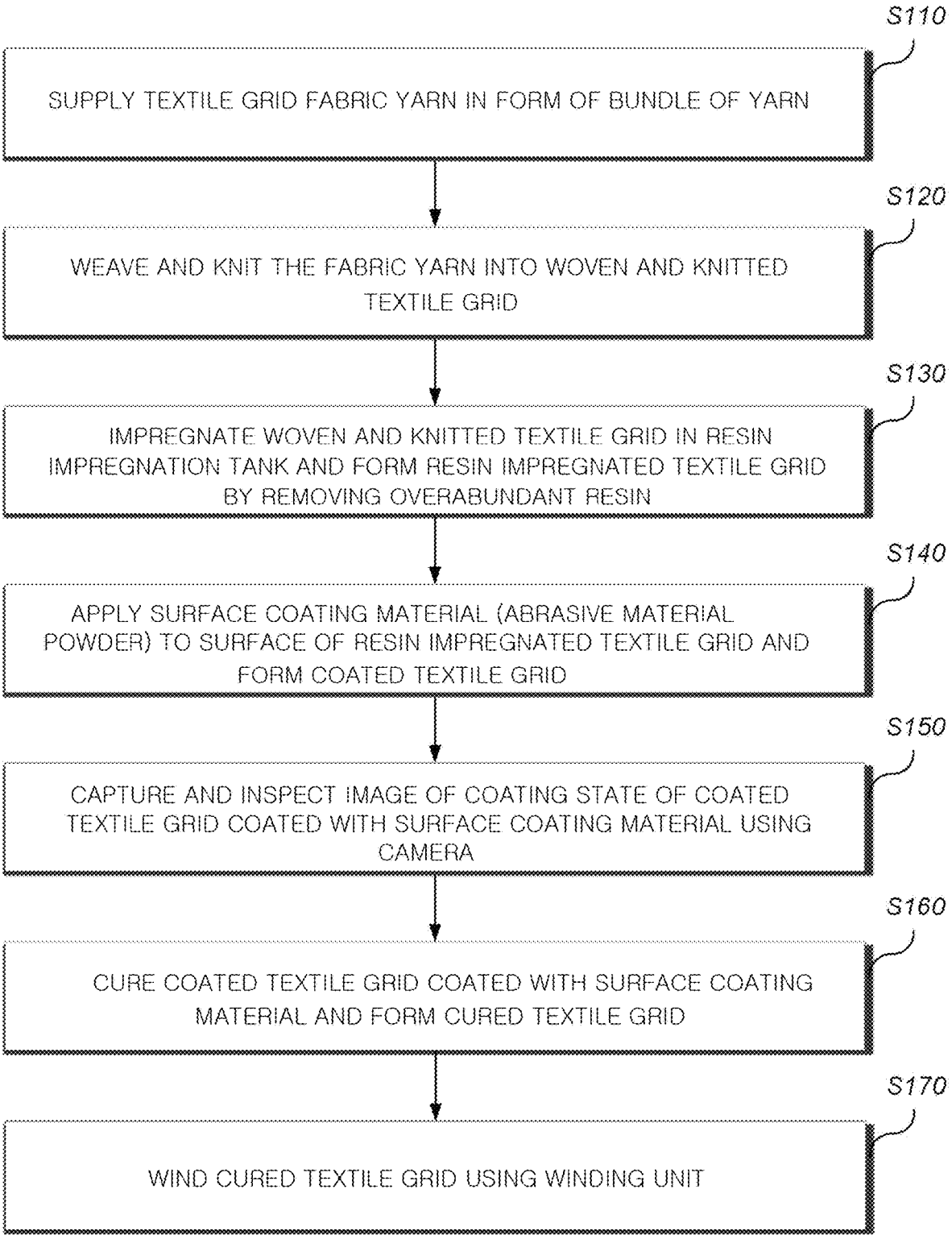
FIG. 10 is an operation flowchart of the method of manufacturing a textile grid with increased adhesion according to the embodiment of the present invention.

FIG. 10 is an operation flowchart of a method of manufacturing a textile grid with increased adhesion according to the embodiment of the present invention.

Referring to FIG. 10, the method of manufacturing a textile grid with increased adhesion according to the embodiment of the present invention is as follows. The fabric yarn supplying unit 110 supplies fabric yarn for a textile grid in the form of a bundle of yarn (step S110).

Next, the weaving-knitting machine 120 weaves and knits the bundle of yarn into a lattice-shaped woven and knitted textile grid 200 through a method in which the wefts and the warps cross to be coupled to each other (step S120).

Next, the woven-knitted textile grid 200 is impregnated with the resin 210 in the resin impregnation tank 130, and an overabundant resin is removed so that the resin impregnated textile grid 220 is formed (step S130).

Next, under control of the controlling device 160, the surface of the resin impregnated textile grid 220 is coated with the abrasive material powders, which are the surface coating materials 230 and 240, in the coating chamber 140 so that the coated textile grid 250 is formed (step S140). In this case, the abrasive material powders may be sand, silica sand, or alumina oxide powder.

Specifically, the controlling device 160 may include a coating-image collecting part 161 that collects a coating-image which is an image of the applied coating material captured by the camera 150, a data processing part 162 that processes data to analyze the coating-image collected by the coating-image collecting part 161, a coating state determining part 163 that determines whether a coating state of the surface of the coated textile grid 250 is appropriate according to the data processed by the data processing part 162, a coating material spray adjusting part 164 that adjusts the spraying amount of the coating material supplied to the first and second coating material spraying nozzles 141 and 142 in the coating chamber 140 when a state of the coating material applied to the surface of the coated textile grid 250 is not appropriate as a determination result of the coating state determining part 163, and a pull-out motor speed adjusting part 165 that adjusts a speed of the pull-out motor M installed in front of the winding unit 190 to adjust the coating amount of the coating material applied to the surface of the resin impregnated textile grid 220.

In this case, when the controlling device 160 determines that the state of the coating material applied on the surface of the coated textile grid 250 is not appropriate, the controlling device 160 may adjust the spraying amount of the coating material supplied to the first and second coating material spraying nozzles 141 and 142 in the coating chamber 140. Further, when the controlling device 160 determines that the state of the coating material applied on the surface of the coated textile grid 250 is not appropriate, the controlling device 160 may adjust a speed of the pull-out motor M installed in front of the winding unit 190 to adjust the coating amount of the coating material applied to the surface of the resin impregnated textile grid 220.

In this case, the coating chamber 140 is formed as a closed space and allows the coating material to be sprayed on both surfaces of the resin impregnated textile grid 220 by using the at least two coating material spraying nozzles 141 and 142, and the spraying amount of the coating material sprayed on the surface of the resin impregnated textile grid 220 may be determined by the sprayed coating material 230 directly sprayed from the first and second coating material spraying nozzles 141 and 142 and the scattered coating material 240 scattered in the coating chamber 140.

Then, referring back to FIG. 10, the coated textile grid 250 coated with the surface coating materials 230 and 240 is captured by the camera 150 so that a coating state is inspected (step S150).

Next, the coated textile grid 250 coated with the surface coating materials 230 and 240 is cured in the resin curing chamber 180 so that the cured textile grid 260 is formed.

Next, the cured textile grid 260 is wound by the winding unit 190 (step S170).

In the case of the method of manufacturing a textile grid with increased adhesion according to the embodiment of the present invention, the textile grid may be coated in an automatic series of processes, and particularly, immediately after the textile grid according to the related art is woven and resin-impregnated, operations of coating and inspecting a surface coating material are serially added. In this case, the resin impregnated textile grid 220 that passes through the resin impregnation tank 130 is impregnated with the resin 210, enters and passes through the coating chamber 140 in an uncured state, and is coated and cured sequentially.

Finally, according to an embodiment of the present invention, when a concrete structure is built, repaired, or reinforced, adhesion of a textile grid is increased so that the textile grid integrates with the concrete structure, and thus structural safety and durability of the concrete structure can be increased.

According to the present invention, when a concrete structure is built, repaired, or reinforced, adhesion of a textile grid is increased so that the textile grid integrates with a concrete structure, and thus a structural safety and durability of the concrete structure can be increased.

According to the present invention, a surface of the textile grid is coated with abrasive material powder, which is a surface coating material, in an automatic series of processes immediately after the textile grid is manufactured, and thus a working speed can be increased.

According to the present invention, the amount of the coating material applied to the surface of the textile grid is automatically inspected and adjusted using a camera, and thus coating performance can be increased.

The above description of the present invention is only exemplary, and it should be understood by those skilled in the art that the invention may be performed in other concrete forms without changing the technological scope and essential features. Therefore, the above-described embodiments should be considered as only examples in all aspects and not for purposes of limitation. For example, each component described as a single type may be realized in a distributed manner, and similarly, components that are described as being distributed may be realized in a coupled manner.

The scope of the present invention is defined not by the detailed description but by the appended claims and encompasses all modifications or alterations derived from meanings, the scope, and equivalents of the appended claims.

What is claimed is:

1. An apparatus for manufacturing a textile grid with increased adhesion for building, repairing, or reinforcing a concrete structure, the apparatus comprising:

a fabric yarn supplying unit that supplies textile grid fabric yarn in a form of a bundle of yam;

a weaving-knitting machine that forms a woven-knitted textile grid in a lattice form through a manner in which the fabric yarn is woven and knitted so that wefts and warps cross to be coupled to each other;

a resin impregnation tank that impregnates the woven-knitted textile grid with a resin to form a resin impregnated textile grid;

a coating chamber that comprises a first coating material spraying nozzle and a second coating material spraying nozzle installed in the coating chamber, configured for coating an abrasive material powder that is a surface coating material onto a surface of the resin impregnated textile grid and which forms a coated textile grid before the resin impregnated textile grid is cured;

a camera that is installed at a rear end of the coating chamber and captures a coating-image to inspect a coating state of the coated textile grid; and a controlling device that adjusts a spraying amount of the surface coating material according to the coating-image captured by the camera, wherein adhesion of the textile grid to a concrete structure is increased by the abrasive material powder that is the surface coating material.

2. The apparatus for manufacturing a textile grid with increased adhesion of claim 1, wherein the coating chamber is formed as a closed space, and coating is performed using at least two coating material spraying nozzles comprising the first coating material spraying nozzle and the second coating material spraying nozzle to spray a coating material to both surfaces of the resin impregnated textile grid.

3. The apparatus for manufacturing a textile grid with increased adhesion of claim 2, wherein the spraying amount of the coating material sprayed on the surface of the resin impregnated textile grid is determined by a sprayed coating material directly sprayed from the first coating material spraying nozzle and the second coating material spraying nozzle and a scattered coating material scattered in the coating chamber.

4. The apparatus for manufacturing a textile grid with increased adhesion of claim 1, wherein the abrasive material powder that is the surface coating material comprises sand, silica sand, or alumina oxide powder.

5. The apparatus for manufacturing a textile grid with increased adhesion of claim 1, further comprising a surface coating material supplying unit that supplies a coating material to the first coating material spraying nozzle and the second coating material spraying nozzle in the coating chamber and adjusts the spraying amount of the coating material under control of the controlling device.

6. The apparatus for manufacturing a textile grid with increased adhesion of claim 5, further comprising:

a resin curing chamber that allows the coated textile grid formed in the coating chamber to be cured to form a cured textile grid; and a winding unit that winds the cured textile grid of the resin curing chamber.

7. The apparatus for manufacturing a textile grid with increased adhesion of claim 1, wherein the controlling device comprises:

a coating-image collecting part that collects a coating image, which is an image of a coated coating material, captured by the camera;

a data processing part that processes data to analyze the coating image collected by the coating-image collecting part;

a coating state determining part that determines whether a coating state of a surface of the coated textile grid is appropriate based on the data processed by the data processing part; and a coating material spray adjusting part that adjusts the spraying amount of the coating material supplied to the first coating material spraying nozzle and the second coating material spraying nozzle in the coating chamber when a state of the coating material applied on the surface of the coated textile grid is not appropriate as a result determined by the coating state determining part.

8. The apparatus for manufacturing a textile grid with increased adhesion of claim 7, wherein the controlling device further comprises a pull-out motor speed adjusting part that adjusts a speed of a pull-out motor installed in front of a winding unit to adjust a coating amount of the coating material applied to the surface of the resin impregnated textile grid.

* * * * *